US005832690A

United States Patent [19]

Kaines

[11] Patent Number: 5,832,690

[45] Date of Patent: Nov. 10, 1998

[54] SPACER FOR DOUBLE CAGE CONCRETE REINFORCEMENT WIRE GRIDS

[76] Inventor: John L. Kaines, 303 N. Gaylord Ave., Ludington, Mich. 49431

[21] Appl. No.: 831,155

[22] Filed: Apr. 1, 1997

[51] Int. Cl.[6] ..... E04C 5/16

[52] U.S. Cl. ..... 52/677; 52/684; 52/712; 52/714

[58] Field of Search ..... 52/677, 684, 712, 52/714

[56] References Cited

U.S. PATENT DOCUMENTS

| | | | |
|---|---|---|---|
| 1,025,330 | 5/1912 | Straus, Jr. . | |
| 1,213,919 | 1/1917 | Symons . | |
| 1,263,887 | 4/1918 | Hamilton . | |
| 1,750,106 | 3/1930 | Heltzel | 52/677 X |
| 1,830,888 | 11/1931 | Ribb . | |
| 3,440,792 | 4/1969 | Schmidgall . | |
| 3,722,164 | 3/1973 | Schmidgall . | |
| 3,840,054 | 10/1974 | Tolliver . | |
| 3,857,416 | 12/1974 | Borodin et al. . | |
| 4,295,501 | 10/1981 | Tolliver . | |
| 4,301,638 | 11/1981 | Schmidgall . | |
| 4,441,527 | 4/1984 | Tolliver . | |
| 4,452,026 | 6/1984 | Tolliver . | |
| 4,466,467 | 8/1984 | Tolliver . | |
| 4,467,995 | 8/1984 | Tolliver . | |
| 4,640,063 | 2/1987 | Ayala | 52/714 X |
| 4,835,934 | 6/1989 | Swenson . | |
| 4,939,883 | 7/1990 | Swenson . | |
| 4,999,965 | 3/1991 | Schmidgall et al. . | |
| 5,042,218 | 8/1991 | Nasca et al. | 52/677 |
| 5,287,672 | 2/1994 | Moore | 52/677 X |
| 5,410,850 | 5/1995 | Dreizler . | |

FOREIGN PATENT DOCUMENTS

| | | |
|---|---|---|
| 723879 | 4/1932 | France . |
| 2109183 | 9/1972 | Germany . |
| 2126981 | 5/1973 | Germany . |
| 547200 | 8/1956 | Italy . |

*Primary Examiner*—Christopher Kent
*Attorney, Agent, or Firm*—Waters & Morse, PC

[57] ABSTRACT

An attachable spacer for maintaining a spaced relationship between first and second wire mesh concrete reinforcing cages is formed of a length of wire and has an elongated central portion adapted to extend between the cages and first and second attachment clips on first and second outer ends of the central portion for attaching the ends of the spacer to the first and second cages. The first attachment clip has a fastener that hooks on a wire of one of the cages so as to resist movement of the spacer in a direction perpendicular to a plane of the cage or transverse to the wire to which the hook is attached. The second attachment clip comprises first and second spaced hooks interconnected by an arm that extends laterally from the second end of the central portion, the hooks being spaced and shaped to fit over and resiliently engage adjacent spaced parallel wires in the second cage so as to restrain the second end of the central portion from movement transverse to the axis of the wires to which the second attachment means is attached. The resilient engagement of the hooks serves to restrain the spacer from rotation about an axis of the central section, locking both ends of the spacer on the spaced cages and restraining the spacer from sliding along the cage wires.

12 Claims, 4 Drawing Sheets

SPACER FOR DOUBLE CAGE CONCRETE REINFORCEMENT WIRE GRIDS

FIELD OF THE INVENTION

The present invention relates to spacers for concrete reinforcement wire and more particularly to double cage spacers that can be installed and removed by hand without any special tools and yet lock securely on the reinforcement cages.

BACKGROUND OF THE INVENTION

Large concrete products, such as culverts or manholes or the like, are molded in large forms and are reinforced with one or more wire grids of reinforcement wire. Metal spacers are used to separate multiple grids of reinforcement wire and also to space the reinforcement grids a predetermined distance from the walls of the form.

Spacers are typically formed of wire, and are commonly tied or welded in place. Clip-on spacers also have been designed. A problem with clip-on spacers is that they are subject to strong dislodging forces during use and must therefore be securely attached. If a clip-on spacer is designed for easy installation, the spacer usually can become dislodged relatively easily. On the other hand, clip-on spacers that are securely mounted often require the use of spring steel wire for the clip and a special prying tool to mount the clip in place. This usually requires a considerable amount of force and makes it difficult to remove the clip once it is in place. Further, the clip has some tendency to slide sideways on the reinforcing wire.

An object of the present invention is to provide a secure clip-on spacer for a multi-cage spacing applications wherein: the spacer can be formed out of ordinary wire and does not require spring steel; and the spacer can be mounted and dismounted easily by hand without the necessity of special tools; yet is securely attached to the reinforcement grid.

SUMMARY OF INVENTION

In accordance with the present invention, a spacer for maintaining a spaced relationship between first and second wire mesh concrete reinforcing cages is formed of a length of wire and comprises an elongated central portion adapted to extend between the cages and first and second attachment clips on first and second outer ends of the central portion for attaching the ends of the spacer to the first and second cages. The first attachment clip comprises a fastener that hooks on a wire of one of the cages so as to resist movement of the spacer in a direction perpendicular to a plane of the cage or transverse to the wire to which the hook is attached. The second attachment clip comprises first and second spaced hooks interconnected by an arm that extends laterally from the second end of the central portion, the hooks being spaced and shaped to fit over and engage adjacent spaced parallel wires in the second cage so as to restrain the second end of the central portion from movement transverse to the axis of the wires to which the second attachment means is attached. The hooks resiliently engage the cage wires such that the arm connecting the first and second hooks is resiliently stressed in an axial direction. The attachment of the first and second hooks to the wires serves to restrain the spacer from rotation about an axis of the central section, and the resilient engagement also serves to restrain the spacer from sliding along the cage wires.

The spacer of the present invention may be made of low cost, non-spring steel wire and is easy to install manually, without any tools, yet the spacer rigidly attaches to a wire cage structure and resists becoming dislodged during use.

These and other features of the present invention will become apparent from the preferred embodiment described below and shown in the appended drawings.

DETAILED DESCRIPTION OF PREFERRED EMBODIMENTS

Figure 1:
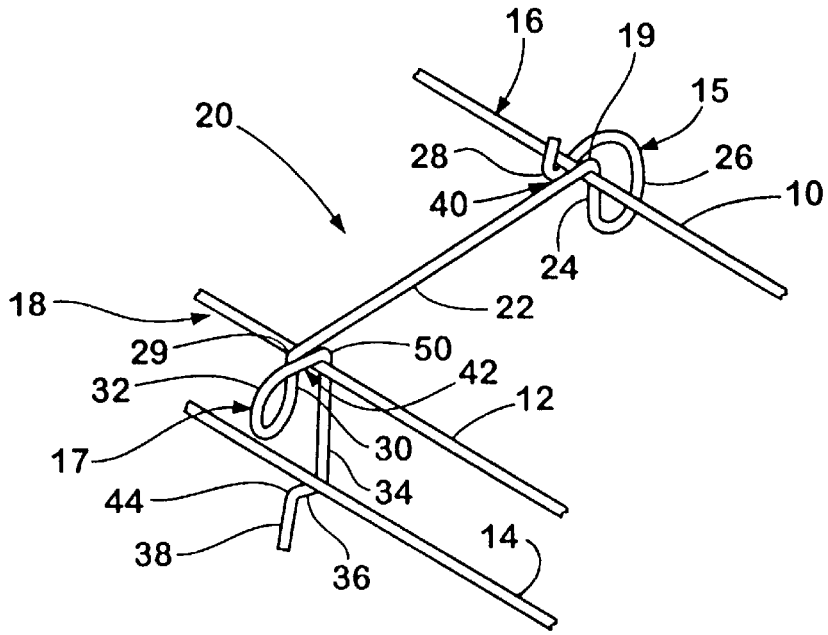
FIG. 1 is a schematic perspective view of the spacer of the present invention, with spacer loops at both ends of the spacer for spacing the wire cages from form surfaces adjacent each side of the cages.
Figure 3:
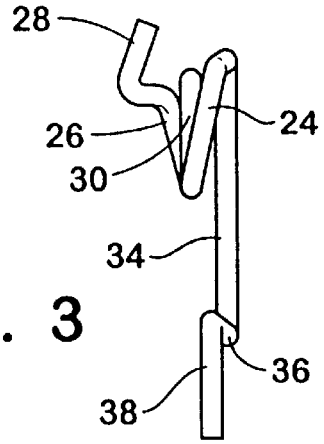
FIG. 3 is an end view of the spacer of FIG. 1.

Referring to the drawings, spaced cage wires 10 and 12 and 14 of separate concrete reinforcement wire cages 16 and 18 are held apart in a spaced relationship by spacer 20 of the present invention. Spacer 20 is formed of a single length of low tensile, bright basic wire preferably having a wire diameter of 0.162 to 0.205 inches (although this wire diameter is not: critical). A diameter of 0.192 inches has been found to be especially suitable. This is conventionally available wire and is relatively easy to manipulate in the configuration of the present invention.

Spacer 20 comprises an elongated central portion 22 that extends between attachment clips 15 and 17 that attach to cage wire 10 of inner cage 16 and cage wires 12 and 14 of outer cage 18. Either cage may be the outer or inner side of the reinforcing cage structure, but it is usually preferred that attachment clip 17 be attached to the outer cage for ease in spacer installation. For exemplary purposes, cage 16 and cage wire 10 will be described as the inner side of the cage structure and cage 18 and cage wire 12 will be described as the outer side of the cage structure. Inward and outward directions shall refer to the direction perpendicular to the planes of the grids or cages. Upward and downward directions are referred to for convenience with references to the orientations shown in the drawings. The spacer is shown mounted with arm 34 facing downwardly, but it could alternatively be mounted in the opposite direction. Similarly, the spacer could be mounted to vertical cage wires.

Central portion 22 separates cage wire 10 from cage wires 12 and 14. Fastener clip 15 is positioned on the inner end of central portion 22 and comprises a right angle segment 23 that extends over wire 10 and then extends along a leg 24 that runs transversely to the axis of the central portion in a downward direction from corner 19 at the outer end of central portion 22. A loop 26 extends inwardly from the cage from the lower or distal end of leg 24 and then curves upwardly and then outwardly toward the cage. Hook 28 extends upwardly and inwardly from the distal end of loop segment 26. Right angle segment 23 fits against the top and inward sides of the cage wire and restrains inward and upward movement of the cage wire, while hook 28 fits on the bottom and outward sides of the cage wire 10 and restrains downward and outward movement of the cage wire.

Clip 17 comprises leg segment 30 that extends perpendicularly downwardly from corner 29 at the outer end of central portion 22. A loop 32 extends outwardly and upwardly from the distal or lower end of leg 30, and extends inwardly from the upper end of loop 30. The wire then has an arm 34 that extends downwardly generally at a right angle from corner 50 at the end of loop 30. Arm 34 extends downwardly from corner 50 to a position below wire 12 and adjacent the next wire 14 in cage 18. The wire then has an outwardly and upwardly extending segment 36 that constitutes an upwardly facing hook that fits under wire 14. The outer end of hook 36 is connected to a downwardly and extending outer segment 38, which serves as a lever in combination with arm 34 for manually mounting the spacer without tools.

This double loop spacer is useful when it is necessary to space the inner and outer cages from inner and outer walls of a concrete form. A loop on the inside end of the spacer may not be necessary for round pipe construction. Typically, the reinforcing grids or cages are placed in position and fastened together and then the walls of the form are lowered over the cages. With the spacer clips of the present invention fitting over the tops of the cage wires and with the loop sections being sloped at the ends of the spacer, if the form walls hit the loops, they will urge the spacer into tighter attachment and will slide by the loops as opposed to catching on the loops and bending or otherwise dislodging the loops, which is a problem with spacers formed of wire prongs.

Figure 4:
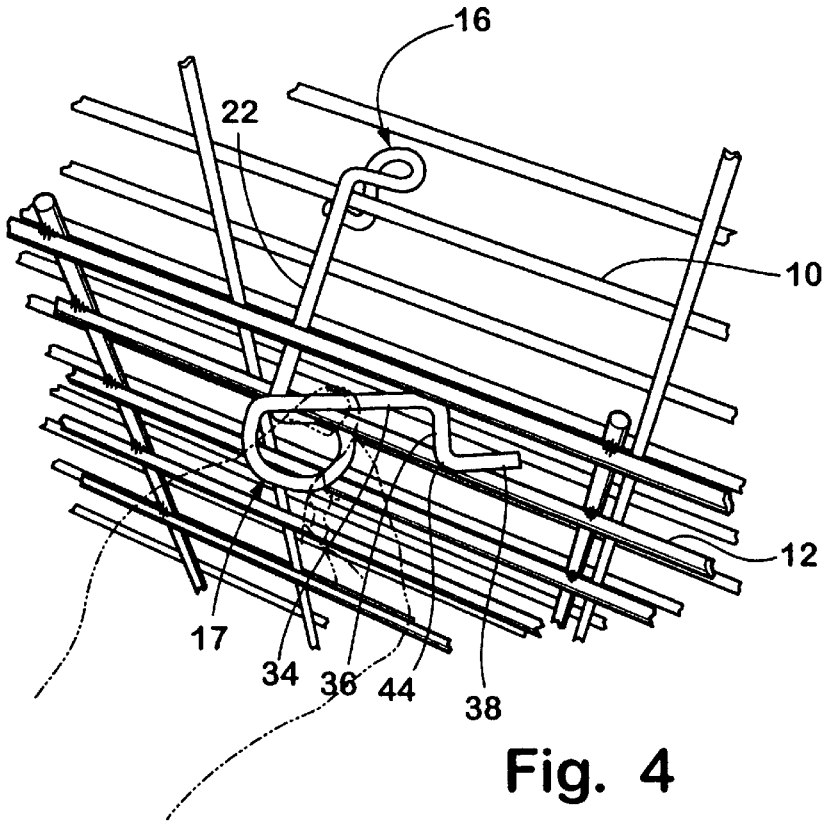
FIGS. 4–8 are schematic views showing the steps followed in the installation of the spacer of FIG. 1 on spaced wire cages.

The manner in which the spacer of the present invention is mounted in a double cage reinforcement structure is shown in FIGS. 4–8. As shown in FIG. 4, the spacer is first oriented with arm 34 in a generally sideways direction, and the spacer is inserted into the cage over wires 10 and 12. Clip 15 is inserted all the way through inner cage 16, so that central portion 22 lies on wire 10. The clip is then moved outwardly so that wire 10 fits in the space 40 between hook 28 and element 24 and thus occupies the position shown in FIG. 4. The hook is spaced apart from central portion 22 by a distance at least equal to the diameter of the cage wire so that the cage wire will fit into the interior of the fastener when the fastener is rotated to the sideways position shown in FIG. 4.

Figure 5:
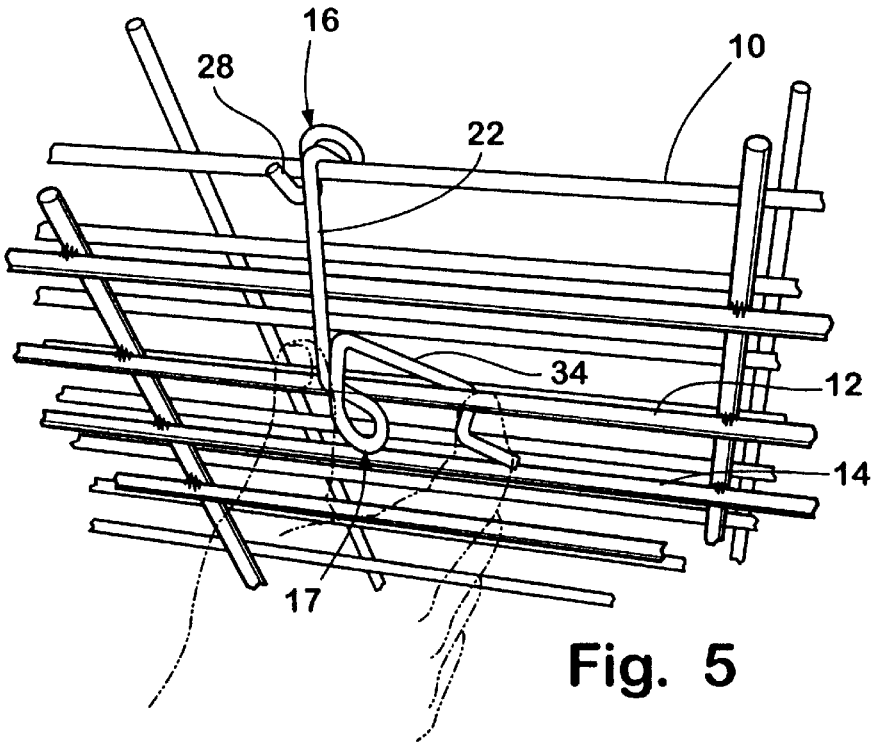

Next, the clip is rotated in a clockwise direction, according to FIG. 5 orientation by twisting the clip between the thumb and forefinger as shown. This rotates clip 15 so that hook 28 is ultimately positioned below and on the outward side of wire 10, and corner 19 and leg 24 are positioned on the top and inward side of cage wire 10. The relative vertical spacings of the bottom of hook 28 and central portion 22 are such that when the arm 34 is rotated directly downwardly and the spacer occupies the position shown in FIG. 1, both the bottom of hook 28 and central portion 22 are snugly engaged against cage wire 10, thereby securely mounting the inner end of the spacer on the inner cage.

Figure 2:
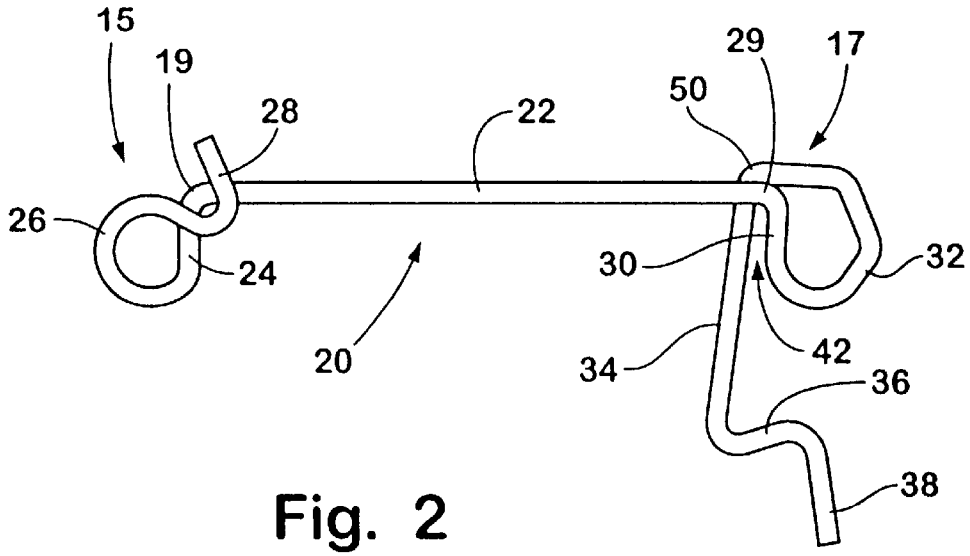
FIG. 2 is a side elevational view of the double loop spacer of FIG. 1.
Figure 6:
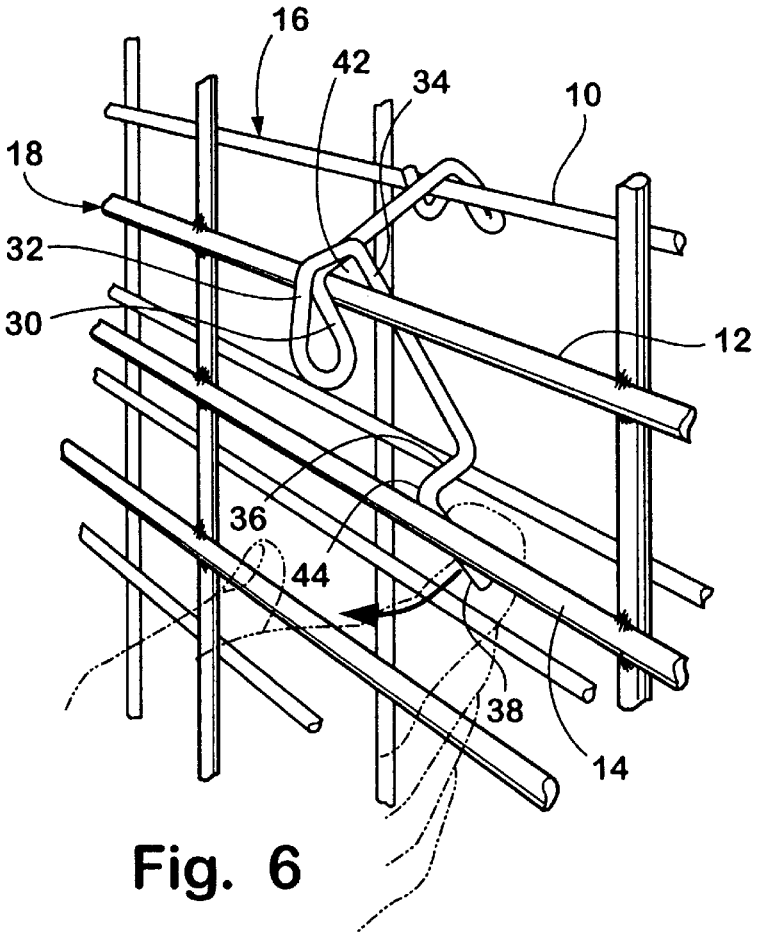

As shown in FIG. 6, as arm 34 is rotated downwardly by manipulation of lever 38, wire 12 is engaged in a U-shaped receptacle 42 between arm 34 on an inward side and leg 32 on an outward side. The distance between arm 34 and leg 32 as shown in FIG. 2 is desirably about the diameter of the largest cage wire that the spacer is going to be used for, which for most purposes is about 0.356 inches. The cage wire thus fits closely in receptacle 42, which constitutes a downwardly facing hook. As arm 34 is pivoted downwardly, the next lower cage wire 14 moves to a position adjacent but slightly below rounded corner 44 between the distal end of hook 36 and lever 38. Desirably, the spacer central portion is skewed at an angle with respect to a line extending perpendicularly between the cages when the spacer arm 34 is rotated from the sideways position shown in FIG. 4 to the vertical position shown in FIG. 8 (as illustrated in FIG.6). This facilitates positioning the arm 34 and hook 36 in a downward position adjacent the inner side of wire 14.

Figure 7:
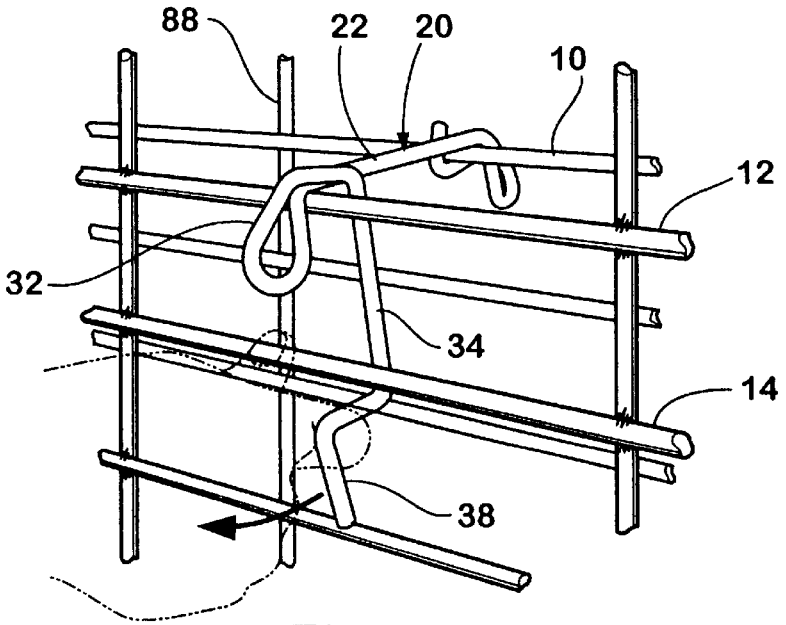
Figure 8:
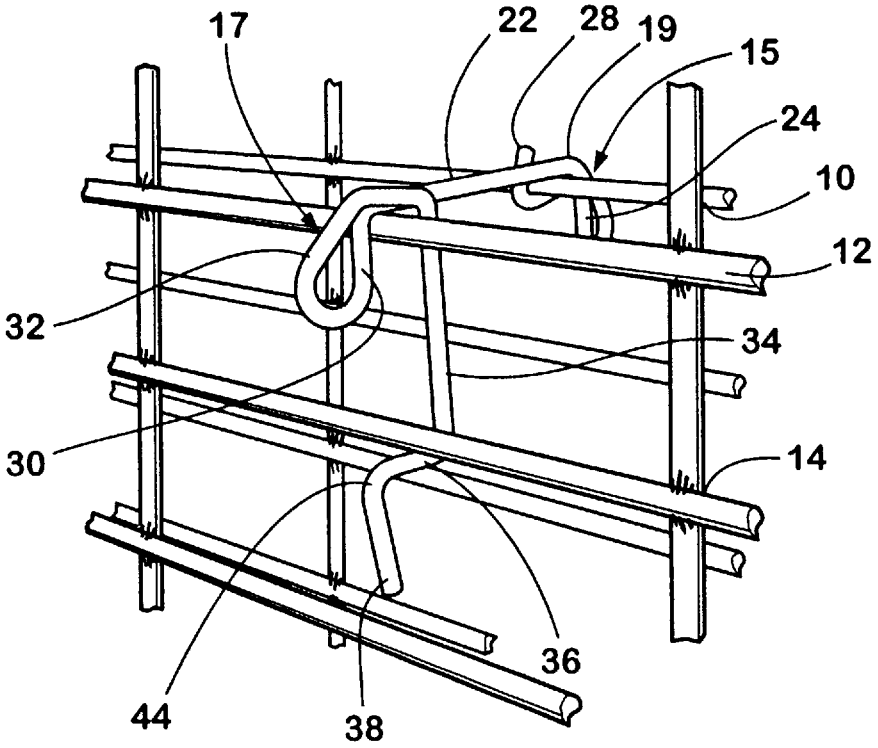

After the clip has been rotated to the point where arm 34 is in a vertical position, as shown in FIG. 7, lever 38 is pulled outwardly as cage wire 14 is pushed inwardly. This causes the cage wire to slip over corner 44 between lever 38 and hook 36. The cage wire then slides downwardly to the recessed inner portion of hook 36 at the junction between arm 34 and section 36, where it rests and is restrained from movement perpendicular to the plane of the cage or transverse to the axis of the cage wire.

Because of the extended length of arm 34 and lever 38, the spacer can be easily mounted manually, without the use of any tools. Yet, the spacer is mounted rigidly between the wire cages. Clip 15 snugly engages wire 10 between hook 28 and corner 19 between central portion 22 and segment 24. At the same time, leg 30 and arm 34 of clip 17 are adjacent inner and outer sides of wire 12, while a vertical resilient gripping force is provided between upwardly facing hook 36 on the bottom of cage wire 14 and downwardly facing hook 42 formed between central portion 22 and wire segment 51 that joins corner 50 at the distal end of loop 32.

Referring to FIG.2, a feature of the present invention is that the segment 51 is positioned vertically higher than central portion 22. This provides tolerance for variations between the spacing of cage wires 12 and 14, which varies significantly in practical applications. For a proper, tight fit, cage wires 12 and 14 should be clamped snugly between hooks 42 and 36, with a resilient axial stress being placed on arm 34. With central section 22 being positioned below segment 51, the cage wire 12 first engages central section 22 at the rear side of recess 42. If the spacing between the cage wires 12 and 14 is greater than the distance between central portion 22 and hook 36, loop 32 acts as a coil spring and permits the downward deflection of hook 36 until segment 51 comes in contact with cage wire 12. Most tolerance variations can be accommodated by positioning segment 51 about one-half of a wire diameter (about 0.090 inches) above the central portion or perhaps as much as one-eighth of an inch.

The spacer of the present invention can be manually installed without tools and yet rigidly remains in place on the cage structure and resists dislodging by the various forces that act upon the spacer during the mounting of the spacer in a concrete form and pouring concrete into the form. This is all accomplished by a spacer that is fabricated from inexpensive wire and does not require spring steel.

Figure 9:
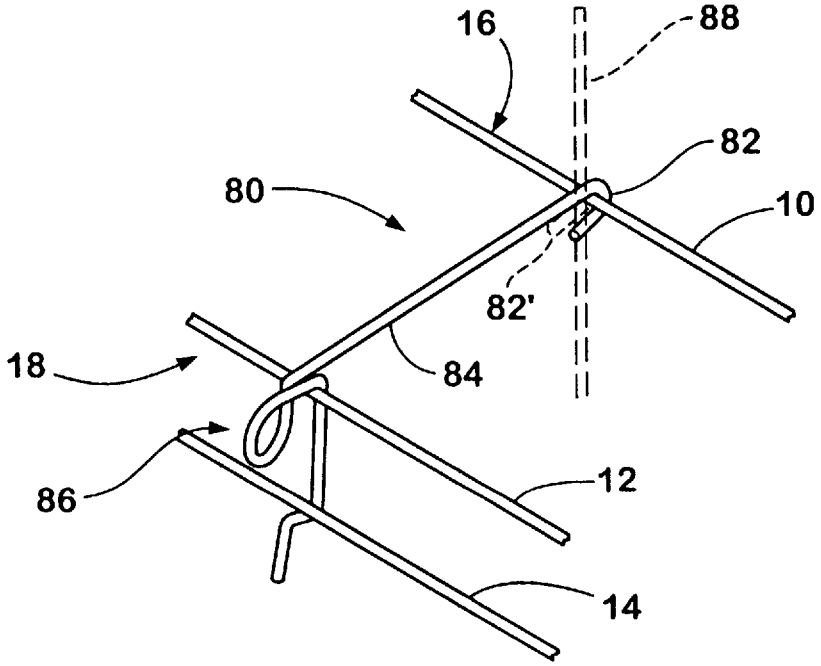
FIG. 9 is a schematic perspective view of a second embodiment of the spacer of the present invention.

While the foregoing embodiment of the invention is preferred for many applications, particularly for non-cylindrical structures, for certain applications it may not be necessary to restrain the inner cage in all directions and it may not be necessary to have a spacer for the concrete form on the inside. In cylindrical pipe, for example, if spacers are spaced around the periphery of the cages, the spacers can simply hook over the inner cages in the manner shown in FIG. 9 and restrain the cages from moving further apart. With this type of arrangement, each spacer will not by itself prevent an inner cage from moving closer to the outer cage, but the spacer on the opposite side of the cylindrical cage will have that effect. Thus, as shown in FIG. 9, spacer 80 can have a simple hook 82 at an inner end of central portion 84. The plane of the hook can be the same as the plane of the attachment clip 86 at the other end (which is the same as clip 17). Alternatively, the hook can be skewed at an angle in either direction (one skewed angle being shown in phantom by element 82'). This facilitates attachment of the hook to a wire intersection wherein a vertical cage wire 88 is attached to horizontal cage wire 10. The manner in which the spacer is attached is substantially the same as described above.

It should be understood that the foregoing is merely illustrative of the preferred practice of the present invention and that various changes and modifications may be made in the details of construction of the invention without departing from the spirit and scope of the invention.

I claim:

1. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising;

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that books on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section, the second attachment means further having a receptacle that receives one of the adjacent spaced parallel wires in the second cage, the receptacle holding the one spaced parallel wire at the second outer end of the central portion and preventing the one spaced parallel wire from moving in a direction along a length of the central portion.

2. A spacer according to claim 1, wherein the first and second hooks on the second end of the central portion have open sides facing each other, the first and second hooks being adapted to grip a wire cage between the hooks, the second hook having a lever surface on a distal end thereof that facilitates manual attachment of the second hook on a cage wire.

3. A spacer according to claim 1 wherein the hooks resiliently engage the wires such that the arm connecting the first and second hook is resiliently stressed in an axial direction, where the spacer is mounted on a cage, the resilient engagement enhancing resistance to spacer dislodgment and restraining the spacer from sliding along the cage wires.

4. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising:

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that hooks on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section;

at least one attachment means further includes a loop of wire extending outwardly from an end of the central portion so as to space the cage from a concrete form positioned adjacent the cage.

5. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising;

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that hooks on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section;

the fastener at the first end of the spacer central portion comprises a right angle section of wire extending from the first end of the central portion, the right angle section including a leg that extends laterally from the first end of the central portion in a direction that is generally parallel to the arm of the second attachment means, the wire that extending outwardly from a distal end of the right angle section leg to form a loop that extends outwardly and then extends inwardly to a distal end of the loop, the distal end of the loop being positioned adjacent to the first end of the central portion and being spaced apart from the central portion, so a cage wire will fit between the central portion and the distal end of the loop when the spacer rotated so the axis of the cage wire is generally transverse to a line extending between the first end of the central portion and the distal end of the loop, the fastener further including a hook extending from the distal end of the loop, the hook extending in a direction generally opposite to the direction of the leg of the right angle section, the hook being positioned and shaped to engage a cage wire on opposite sides from the right angle section when the spacer is mounted on a cage, the fastener thus restraining transverse movement of the spacer with respect to the plane of the first cage and with respect to the cage wire on which the spacer is mounted.

6. A spacer according to claim 5 wherein the first attachment means is shaped such that it can be mounted on a cage wire by rotating the spacer about the axis of the central portion so that the cage wire is positioned to be between the distal end of the loop and the first end of the central section, the fastener being shaped such that when the fastener has thus been mounted of the cage wire and is thereafter rotated about the axis of the central portion, the right angle section and hook will engage opposite sides of the cage wire and hold the spacer in a fixed transverse position with respect to the cage wire.

7. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising;

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that hooks on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section;

the first and second hooks on the second end of the central portion have open sides facing each other, the first and second hooks being adapted to grip a wire cage between the hooks, the second hook having a lever surface on a distal end thereof that facilitates manual attachment of the second hook on a cage wire;

the second attachment means further comprises a loop extending outwardly from the central portion to space a concrete form away from the second cage.

8. A spacer according to claim 7, wherein the first hook has recessed rear side that is generally in alignment with the central portion of the spacer, said rear side being spaced further away from the second hook than the central portion, such that when the first hook is mounted on a cage wire, the cage wire first engages the central portion instead of the rear side of the first hook, axial tension on the arm caused by mounting the first and second hooks on cage wires causing deflection of the central portion away from the second hook before the cage wire engages the rear side of the first hook.

9. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising;

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that hooks on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section;

the second attachment means comprises a right angle section extending from the second end of the central portion, the right angle section including a leg extending transversely with respect to the second end of the central section in the same general direction as the arm connecting the first and second hooks, the leg being spaced outwardly from the arm by a distance of sufficient to at least resiliently receive therebetween one of the cage wires on which the second attachment means is mounted, a distal end of the leg being connected to a proximal end of the arm by an interconnecting wire segment, the right angle section and arm forming a U-shaped hook that constitutes the first hook, the second hook extending from a distal end of the arm in an outward and upward direction therefrom, so that the second hook generally faces the first hook, the hooks been adapted to resiliently grip adjacent wires of a cage therebetween.

10. A spacer according to claim 9 wherein the interconnecting wire segment is an outwardly extending loop that serves to space the cage from a concrete form.

11. A spacer for maintaining a spaced relationship between first and second wire mesh concrete reinforcing cages, wherein each cage comprises a wire grid formed of a plurality of spaced, generally parallel cage wires interconnected by transversely extending, spaced, generally parallel cage wires, the spacer being formed of a length of wire and comprising;

an elongated central portion adapted to extend between the cages, the central portion having first and second outer ends at opposite ends thereof;

first and second attachment means on the first and second outer ends of the central portion for attaching the ends of the spacer to the first and second cages;

the first attachment means comprising a fastener that hooks on at least one wire of one of the cages so as to resist movement of the spacer in at least one direction perpendicular to a plane of the cage;

the second attachment means comprising first and second spaced hooks interconnected by an arm that extends laterally from the second end of the central portion, the hooks being spaced and shaped to fit over and engage adjacent spaced parallel wires in the second cage so as to restrain the second end of the central portion from a movement transverse to the axis of the wires to which the second attachment means is attached, the attachment of the first and second hooks to the wires serving to restrain the spacer from rotation about an axis of the central section;

the fastener of the first attachment means has an open position, wherein the fastener can be fitted on a cage wire, and a closed position, wherein the fastener and is locked on the cage wire and cannot be removed therefrom, the open and close positions occurring at different angles of a axial rotation of the central portion with respect to the cage wire, the fastener being in its closed position when the first and second hooks of the second attachment means are engage with the cage wires of the second cage, the fastener being in its open position when the second hook of the second attachment means is released from the cage wire and the central portion of the spacer is rotated axially from the closed position, a predetermined distance in a predetermined direction.

12. A spacer according to claim 11 wherein the predetermined distance is a rotational angle of approximately 90 degrees.

* * * * *